United States Patent [19]

Berber et al.

[11] 4,161,275

[45] Jul. 17, 1979

[54] CENTRIFUGAL LIQUID CLEANER

[76] Inventors: Viktor A. Berber, Shelkovichnaya ulitsa, 184, kv. 65; Vladimir I. Mozyakov, Shelkovichnaya ulitsa, 190, kv. 47; Nikolai A. Khodosov, Oktyabrsky poselok, 6 linia, 36, all of Saratov, U.S.S.R.

[21] Appl. No.: 909,294

[22] Filed: May 24, 1978

[51] Int. Cl.[2] ..... B04B 11/02

[52] U.S. Cl. ..... 233/31; 233/46

[58] Field of Search ..... 233/3, 27, 28, 29, 31, 233/37, 43, 45, 40, 30, 46

[56] References Cited

U.S. PATENT DOCUMENTS 3,858,793 1/1975 Dudrey ..... 233/31

FOREIGN PATENT DOCUMENTS 2204031 8/1973 Fed. Rep. of Germany ..... 233/31

*Primary Examiner*—George H. Krizmanich

*Attorney, Agent, or Firm*—Steinberg and Blake

[57] ABSTRACT

A centrifugal liquid cleaner comprises a vertically extending hollow axle fixedly secured to a base, the axle having an inlet and an outlet for liquid. The axle supports a cylindrical rotor having a casing accommodating a sleeve which is coaxial with the hollow axle and has a band wound in a spiral and fixed to the sleeve, and spacers are mounted in a succession in the radial direction between adjacent turns of the spiral to extend in parallel with the hollow axle, the spacers defining, with the band, apertures for the passage of liquid. The band has longitudinally extending ridges verticaly spaced along the entire height thereof cambering towards the hollow axle. This construction of the centrifugal liquid cleaner enables an improvement of fineness of liquid cleaning by several times.

3 Claims, 4 Drawing Figures

CENTRIFUGAL LIQUID CLEANER

The invention relates to apparatus for cleaning liquids, and more particularly to centrifugal liquid cleaners.

The centrifugal liquid cleaner according to the invention may be most advantageously used for cleaning liquids (oil, fuel and the like) from mechanical impurities.

Known in the art is a centrifugal liquid cleaner comprising a vertically extending hollow axle fixedly secured to a base and having an inlet and an outlet for the passage of liquid. A cylindrical rotor is journalled on the axle by means of sliding contact bearing supports, the rotor comprising a casing, a sleeve having a spiral band fixed thereto and lower and upper impellers mounted over and beneath the spiral, respectively.

Spacers are arranged in a succession in the radial direction between adjacent turns of the band spiral to define concentrical apertures with the band. Spaces defined by impeller flanges and end faces of the band spiral are used for admitting liquid to be cleaned to the apertures and for removing cleaned liquid therefrom.

Under the action of the centrifugal field, liquid is separated from mechanical particles in the apertures, and the mechanical particles precipitate to the band surface.

As the gap between adjacent turns of the spiral decreases in the cleaner of the above-described type, losses of precipitated particles with the liquid flow increase which is especially pronounced with an increase in flow rate, as well as in cleaning liquids having a small difference in densities of dispersed and dispersion media, thus impairing quality of liquid cleaning.

It is an object of the invention to provide a centrifugal liquid cleaner in which the rotor band has such a construction as to improve quality of liquid cleaning from mechanical impurities.

Another object of the invention is to prolong the time of continuous operation of the cleaner without removal of precipitate from the rotor.

With these and other objects in view there is provided a centrifugal liquid cleaner comprising a vertically extending hollow axle fixedly secured to a base and having an inlet and an outlet for liquid communicated with the corresponding spaces of a rotor mounted on the hollow axle having a casing accommodating a sleeve which is coaxial with the hollow axle and has a spiral band fixed thereto, and spacers arranged in a succession in the radial direction between adjacent turns of the band to extend in parallel with the hollow axle so as to define, with the band, apertures for the passage of liquid, wherein, according to the invention, the band has longitudinally extending ridges vertically spaced along the height of the band and cambering towards the hollow axle.

The height of each ridge is preferably equal to from 0.1 to 0.6 of the distance between adjacent turns of the spiral, and the spacing of the ridges is equal to from 0.2 to 0.04 of the band height.

The surface of each ridge facing the direction of liquid flow is preferably at an angle substantially equal to 90° to the band surface.

The selection of the ridge height and spacing of the ridges within the above-specified ranges enables maximum efficiency of liquid cleaning and precipitate accumulation on the band surface which, in turn, permits the time of continuous operation of the centrifugal cleaner without precipitate removal from the rotor to be prolonged for a greater period.

The centrifugal liquid cleaner according to the invention allows an improvement of cleaning fineness by several times, especially in cleaning liquids from impurities of relatively low density, such as rubber particles.

The invention will now be described with reference to a specific embodiment thereof illustrated in the accompanying drawings, in which.

The centrifugal liquid cleaner comprises a hollow axle 1 (FIG. 1) which is fixedly secured with the lower end thereof to a base 2. A space "B" of the axle 1 at the lower part thereof communicates with a pipe 3 for admitting liquid to be cleaned to the cleaner and with a pipe 4 for removal of cleaned liquid.

Figures 1, 2:
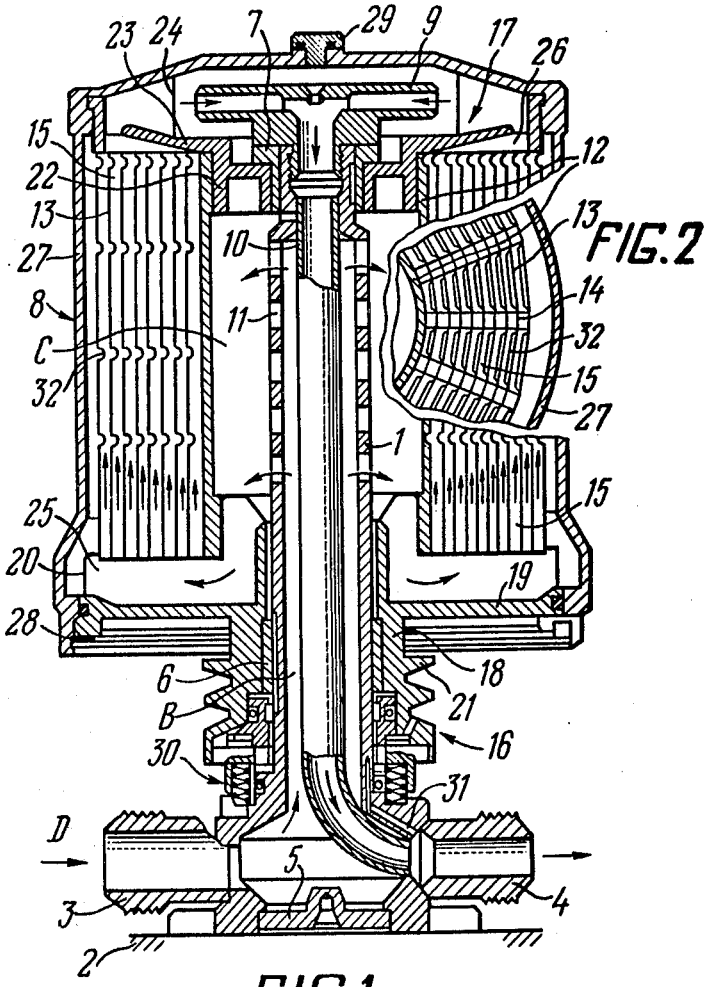
FIG. 1 is a longitudinal section of the centrifugal liquid cleaner according to the invention.
FIG. 2 is a fragment of the cross-section of the band spiral.

The fixed end of the axle 1 is closed by a flange 5. A cylindrical rotor 8 is journalled on the axle 1 by means of bearing supports 6 and 7 for imparting rotation to the liquid being cleaned. A pressurizing disc 9 is mounted to the upper end of the axle 1 to connect the inner space of the rotor 8, via a pipe 10 accommodated in the space "B" of the axle 1, to the pipe 4. The pressurizing disc 9 is designed for pumping the liquid being cleaned and functions at the same time as an upper thrust bearing of the rotor 8. Apertures 11 are provided in the middle portion of the axle 1 for admitting liquid to the inner space of the rotor 8. The rotor 8 includes a sleeve 12 having a band 13 which is wound thereon in the form of a spiral, and spacers 14 are arranged between the turns of the spiral in parallel with the axle 1 in a succession in the radial direction (FIG. 2). The spacers 14 define, with the turns of the band 13, apertures 15, the amount of gap between the apertures being determined by the thickness of the spacers 14. A lower impeller 16 and an upper impeller 17 are press fitted in the sleeve 12 over and beneath the band spiral 13, respectively. The lower impeller 16 comprises a cylindrical portion 18 which is fitted on the axle 1, and flange 19 having equally circumferentially spaced ribs 20 and a lower portion in the form of a pulley 21 which is designed for connecting the rotor to a drive (not shown) by means of a V-belt transmission (not shown). The impeller 16 is used for whirling the liquid and for centering the rotor in the bearing support 6.

The upper impeller 17 comprises a cylindrical portion 22 which is fitted on the axle 1, and a flange 23 having radial equally circumferentially spaced ribs 24 and is designed for centering the rotor 8 in the bearing support 7 and for whirling the liquid.

For admitting liquid to the apertures 15, there are provided a space "C" defined by the sleeve 12 and the axle 1, and radial passages or spaces 25 defined by the ribs 20 and the flange 19 of the impeller 16 and the lower end face of the band spiral 13.

For removing liquid from the apertures 15, there are provided radial passages or spaces 26 defined by the upper end face of the band spiral 13, the flange 23 and the ribs 24 of the impeller 17.

The rotor 8 is closed by a casing 27 which is locked on the flange 19 of the impeller 16 by means of a retaining ring 28.

The upper portion of the casing 27 has an air exhaust port for expulsion of air during the filling of rotor with liquid, which is closed by means of a plug 29. To prevent liquid leakage from the rotor 8, there is provided a seal 30 mounted between the lower impeller 16 and the axle 1.

For feeding cleaned liquid to the seal 30 and to the bearing support 6, a passage 31 is provided in the axle 1.

Figure 3:
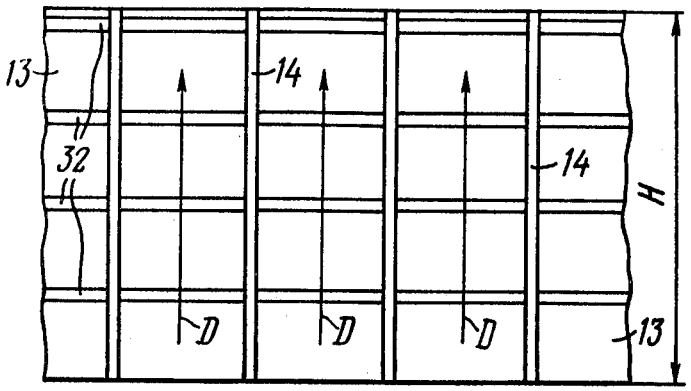
FIG. 3 is a developed view of the band and spacers.

The band 13 is provided with ridges 32 extending longitudinally thereover as shown in FIG. 3.

Figure 4:
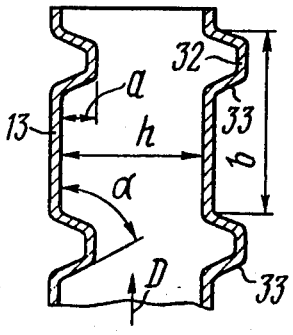
FIG. 4 is an enlarged detail A in FIG. 1.

The ridges camber towards the axle 1 as shown in FIG. 2. The height "a" of each ridge 32 (FIG. 4), which is selected experimentally, is equal from 0.1 to 0.6 of the distance "h" between adjacent turns of the spiral.

The ridges 32 are vertically spaced along the entire height H of the band with a spacing "b" which is equal from 0.2 to 0.04 of the height H of the band. The surface 33 of each ridge 32 facing the direction of liquid flow shown by arrow "D" is at an angle "$\alpha$" to the surface of the band 13 which is substantially equal to 90°. This arrangement of the ridges 32 enables maximum efficiency of liquid cleaning in the centrifugal cleaner.

The centrifugal liquid cleaner functions in the following manner.

The rotor 8 filled up with liquid is caused to rotate by means of a drive (not shown) via a V-belt transmission (not shown). The liquid to be cleaned is admitted to the centrifugal cleaner through the pipe 3. The direction of flow is shown by arrows D. The liquid gets to the radial passages or spaces 25 through the space "B," apertures 11 in the axle 1 and space "C." In the radial passages, the liquid is whirled by means of the ribs 20 of the impeller 16 to gain the angular velocity of the rotor 8 and is admitted to the apertures 15. Impurity particles having a density different from that of the liquid being cleaned precipitate to the surface of the band 13 under the action of centrifugal forces, and the cleaned liquid gets through the passages 26 to the pressurizing disc 9 and is pumped therefrom under pressure, via the pipes 10 and 4, to a user (not shown). Impurity particles having a density close to that of the liquid being cleaned are entrained with the liquid flow over the surface of the band 13 until they hit against a barrier in the form of the surface 33 of the ridge 32. The movement of particles along the surface 33 of the ridge 32 is opposed by the centrifugal force which is directed opposite to the direction of particle movement.

Said particles are accumulated at the surface 33 of the ridges 32 until the height of precipitate become equal to the height "a" of the ridges 32. The amount and maximum height of impurity particles precipitate accumulated on the surface of the band 13 depend on selection of the spacing "b" and height "a" of the ridges 32.

The selection of the height "a" of each ridge 32 within the range from 0.1 to 0.6 of the distance "h" between adjacent turns of the spiral and the selection of the spacing "b" of the ridges 32 within the range from 0.2 to 0.04 of the height "H" of the band ensure the best quality of liquid cleaning and maximum amount of impurity precipitate accumulated at the surface of the band 13.

The above-described centrifugal liquid cleaner makes it possible to clean fuel from particles of a size to 1.5 mcm with a throughput capacity of up to 50 l/min and oil from particles of a size to 3 mcm with a throughput capacity of up to 30 l/min.

What we claim is:

1. A centrifugal liquid cleaner comprising: a base; a hollow axle which is vertically arranged and fixedly secured to said base, said axle having an inlet for liquid to be cleaned and an outlet for cleaned liquid; a cylindrical rotor mounted on said hollow axle for rotation thereabout; a drive for rotating said cylindrical rotor; said cylindrical rotor having: an upper impeller and a lower impeller, a sleeve coaxial with said hollow axle mounted between said upper and lower impellers and connected thereto for combined rotation, a band of a height substantially equal to the sleeve height having one end fixed to said sleeve and wound thereon in the form of a spiral, spacers arranged in a succession in the radial direction between the turns of the spiral of said band in parallel with said hollow axle, apertures for the passage of cleaned liquid defined by said spacers and said band; ridges provided longitudinally on said band vertically spaced along its height and cambering towards said hollow axle, a casing connected to said upper and lower impellers to close said sleeve and band, and upper and lower impellers, spaces in said casing between the end faces of said sleeve and band and said upper and lower impellers, one of said spaces communicating with the inlet and the other with the outlet of said hollow axle, said spaces communicating with each other through said apertures; a pressurizing disk mounted in said casing on said hollow axle above the upper impeller.

2. A centrifugal liquid cleaner according to claim 1, wherein the height of each ridge is from 0.1 to 0.6 of the distance between adjacent turns of the spiral, and the spacing of the ridges is equal to from 0.2 to 0.04 of the band height.

3. A centrifugal liquid cleaner according to claim 1, wherein the surface of each ridge facing the direction of liquid flow is at an angle substantially equal to 90° to the surface of the band.

* * * * *